US006063016A

United States Patent [19]

Maiwald et al.

[11] Patent Number: 6,063,016

[45] Date of Patent: May 16, 2000

[54] APPARATUS FOR COATING RUNNING WEBS WITH FLOWABLE MATERIAL

[75] Inventors: Berthold Maiwald, Schwarzenbek; Torsten Moerke, Dissau; Heidi Stolz, Oststeinbek; Maik Boettcher, Lauenburg, all of Germany

[73] Assignee: Hauni Maschinenbau AG, Germany

[21] Appl. No.: 09/127,759

[22] Filed: Jul. 31, 1998

[51] Int. Cl.[7] ..... A24C 5/50

[52] U.S. Cl. ..... 493/333; 493/280

[58] Field of Search ..... 493/39, 49, 132, 493/266, 277–283, 331, 333, 336, 337

[56] References Cited

U.S. PATENT DOCUMENTS

| | | | |
|---|---|---|---|
| 1,651,627 | 12/1927 | Parks | 93/56 |
| 1,886,231 | 11/1932 | Sague | 93/56 |
| 2,147,223 | 2/1939 | Vergobbi | 493/337 X |
| 2,167,357 | 7/1939 | George | 93/56 |
| 2,301,067 | 11/1942 | Morgan | 493/279 |
| 2,307,142 | 1/1943 | Lee | 493/337 X |
| 2,333,440 | 11/1943 | Potdevin | 493/266 X |
| 3,693,510 | 9/1972 | Langan | 93/1 G |
| 4,501,579 | 2/1985 | Boegli et al. | 493/337 X |
| 5,044,482 | 9/1991 | Kramer | 193/37 |

*Primary Examiner*—David A. Scherbel
*Assistant Examiner*—Anthony Ojini
*Attorney, Agent, or Firm*—Venable; George H. Spencer; Robert Kinberg

[57] ABSTRACT

A paster which serves to apply a film of adhesive material to the underside of a running web of flexible material, such as tipping paper in a filter cigarette maker, has a roller which supplies successive increments of the film to the underside of the running web and cooperates with a biasing device which rides on the web and urges certain portions of the underside of the web against the roller. The length of the area of contact between the biasing device and the upper side of the running web is less than the width of the web. This renders it possible to prevent or to minimize undesirable flow of adhesive laterally beyond the marginal zones of the web as well as into perforations which are customarily provided in webs of tipping paper.

19 Claims, 2 Drawing Sheets

Fig.1
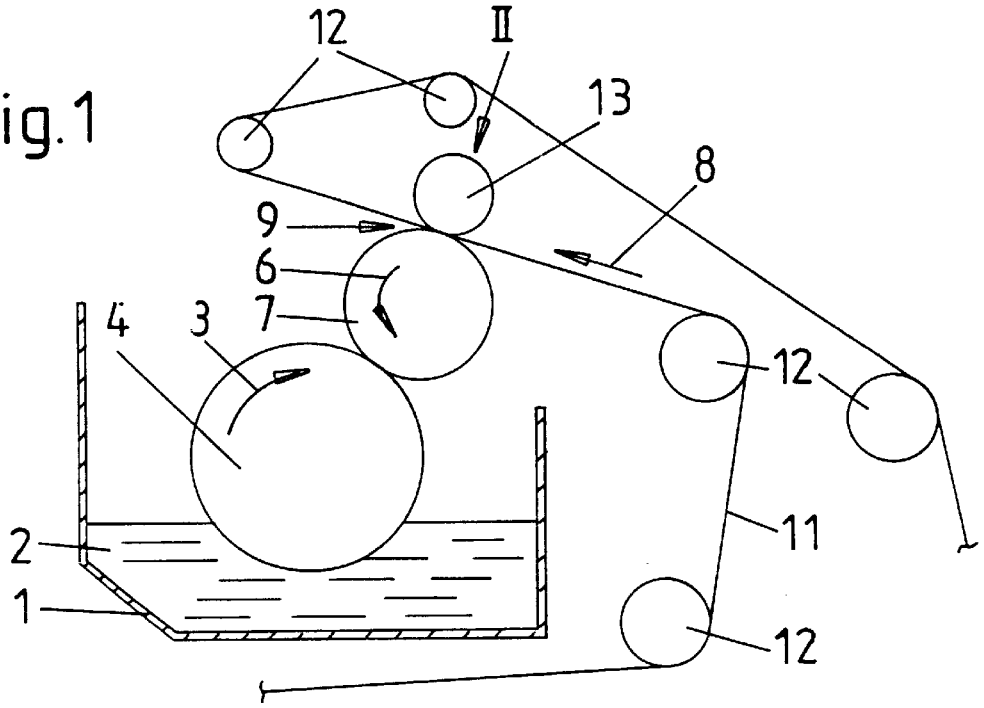
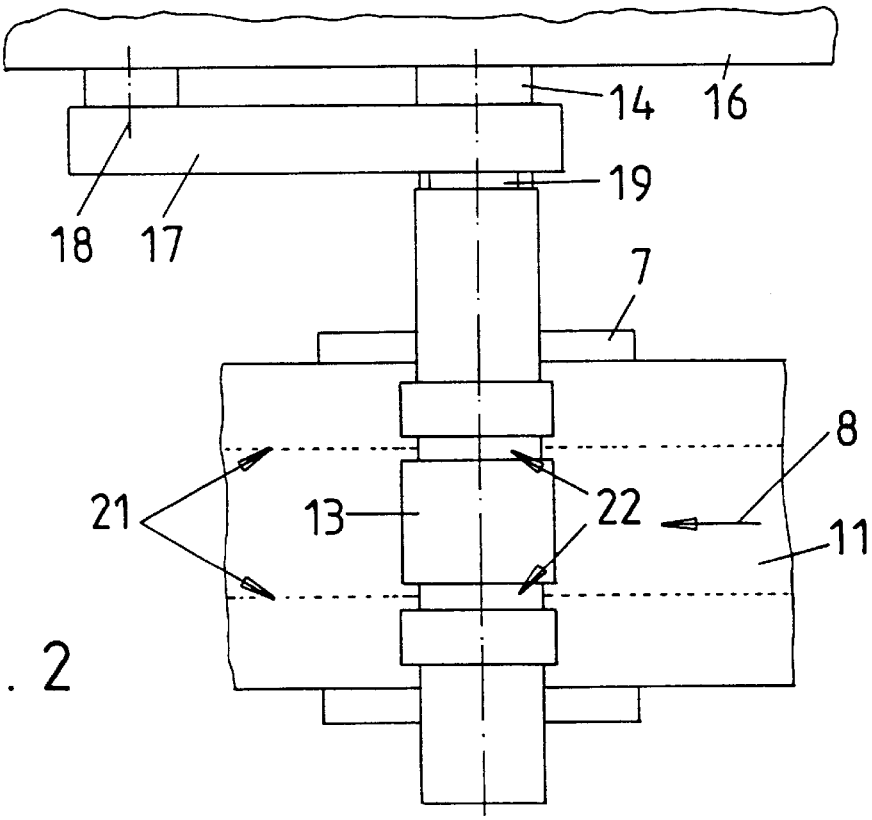
Fig. 2

APPARATUS FOR COATING RUNNING WEBS WITH FLOWABLE MATERIAL

CROSS-REFERENCE TO RELATED CASES

This application claims the priority of German patent application Serial No. 197 33 446.6 filed Aug. 2, 1997. The disclosure of the German patent application, as well as that of each patent mentioned in the specification of the present application, is incorporated herein by reference.

BACKGROUND OF THE INVENTION

The invention relates to improvements in apparatus for applying films or coats of flowable material to selected sides of running flexible webs of paper or the like. Typical examples of such apparatus are pasters which are utilized in so-called filter tipping machines to coat one side of a running web of so-called tipping paper (such as cigarette paper or imitation cork) with a suitable adhesive. The web of adhesive-coated tipping paper is thereupon severed at regular intervals to yield discrete sections or patches, called uniting bands, which are ready to be convoluted around groups of coaxial plain cigarettes, cigarillos or cigars and filter rod sections of unit length or multiple unit length to form therewith filter cigarettes, cigars or cigarillos of unit length or multiple unit length.

A filter tipping machine wherein a paster is used to coat one side of the running web of tipping paper with a film of adhesive (such as hot melt) is disclosed, for example, in U.S. Pat. No. 4,249,547 granted Feb. 10, 1981 to Hinzmann for "METHOD AND APPARATUS FOR APPLYING ADHESIVE TO RUNNING WEBS OF WRAPPING MATERIAL" and in the corresponding published German patent application Serial No. 30 13 979 A1.

Published German patent application Serial No. 43 09 951 of Berger discloses a paster which can be utilized to coat one side of a running web of tipping paper with a suitable adhesive substance. This paster employs a plenum chamber wherein the pressure of confined adhesive varies as a function of the speed of a rotor having a profiled peripheral surface serving to transfer an adhesive pattern to one side of a web which is advanced through a coating station where the one side of the web comes in contact with the adhesive furnished by the profiled peripheral surface of the rotor. The latter cooperates with a roller which bears upon the upper sides of successive increments of the running web to thus urge the underside of the web against the profiled peripheral surface of the rotor.

A drawback of the just discussed paster is that the roller is likely to squeeze a certain percentage of applied adhesive beyond the marginal zones of the web so that the thus expelled adhesive contaminates the parts which guide the coated web on its way toward the severing or subdividing station. The displaced adhesive is also likely to contaminate (and to thus render necessary frequent cleaning of) the component parts of the device which repeatedly severs the leader of the coated web to form a file of discrete adhesive-coated uniting bands ready to be used to unite tobacco-containing rod-shaped articles with filter rod sections.

The aforementioned U.S. Pat. No. 4,249,547 to Hinzmann discloses an apparatus which is designed to apply to one side of a running cigarette paper web or the like a pattern of adhesive patches or fields including patches having a greater thickness and patches of lesser thickness. This can result in undesirable flow and in less than satisfactory distribution of flowable adhesive while the uniting bands are being convoluted around the abutting end portions of filter mouthpieces and rod-shaped tobacco containing sections, such as plain cigarettes of unit length or multiple unit length. Thus, whereas the application of adhesive patterns having portions or sections of different thicknesses can reduce the likelihood of contamination of parts (such as pulleys, walls or the like) which guide the coated web to severing and filter tipping stations, the adhesive is more likely to contaminate the ultimate products, such as filter cigarettes, cigars or cigarillos.

The entire disclosures of the aforementioned German patent applications Serial Nos. 30 13 979 A1 of Hinzmann and 43 09 951 of Berger are also to be considered as being incorporated by reference into the specification of the present application.

OBJECTS OF THE INVENTION

An object of the present invention is to provide a novel and improved apparatus for the application of a flowable material to one side of a running strip or web which is constructed and assembled and operates in such a way that the applied flowable material is not likely to contaminate the parts which guide the freshly coated web, even if the applied flowable material does not form patches or islands having different thicknesses.

Another object of the invention is to provide an apparatus which exhibits the advantages but not the drawbacks of conventional apparatus for the application of flowable materials to selected sides of running strips or webs of paper or the like.

A further object of the invention is to provide an apparatus of the above outlined character wherein the application of an adhesive or another flowable material to a running web is extremely simple (because one side of the web can be entirely coated with a film of uniform thickness) but the thus applied flowable material is still unlikely or less likely to contaminate the parts which guide the freshly coated web, the parts which are utilized to subdivide the freshly coated web into discrete patches or bands or the like, and/or which drape the uniting bands around abutting ends of coaxial rod-shaped articles, e.g., plain cigarettes and filter rod sections in filter tipping machines.

An additional object of the invention is to provide novel and improved means for finalizing the distribution of a flowable material which has been applied to one side of a running web of cigarette paper or the like.

Still another object of the invention is to provide an apparatus which can be utilized with particular advantage in tipping machines for cigarettes, cigarillos or the like because it is unlikely to contaminate, or to cause contamination of, the tipping machine and/or of the ultimate products.

A further object of the invention is to provide an apparatus which can be utilized with advantage to apply adhesive paste to perforated webs of tipping paper, i.e., to webs which are provided with rows or other arrays or distributions of perforations for entry of atmospheric air into the column of tobacco smoke flowing toward and/or through a filter mouthpiece.

A further object of the invention is to provide an apparatus of the above outlined character for use in a filter tipping machine wherein the apparatus allows for a reduction of the pressure which is exerted upon uniting bands of tipping paper during conversion of such uniting bands into tubular envelopes joining rod-shaped tobacco-containing parts with rod-shaped smoke filtering parts of filter tipped smokers' products.

An additional object of the invention is to provide a filter tipping machine which embodies or cooperates with one or more apparatus of the above outlined character.

A further object of the invention is to provide a novel and improved method of manipulating a running strip or web of tipping paper or the like preparatory to as well as during coating of one side of the web with an adhesive substance (such as a hot melt) or any other flowable material.

SUMMARY OF THE INVENTION

The invention is embodied in an apparatus for applying a film of flowable material (such as an adhesive substance) to one side of an elongated flexible web (e.g., a paper-containing web) having a predetermined width and advancing lengthwise in a predetermined direction along a predetermined path through a coating station. The improved apparatus comprises a film supplying device which is located at the coating station at the one side of the advancing web to provide the one side with the film of flowable material, and means for biasing the one side of the advancing web against the film supplying device at the coating station. In accordance with a desirable feature of the invention, the biasing means is adjacent another side of the web opposite the one side (i.e., adjacent the upper side if the underside of the running web is being coated with a flowable material), and the biasing means contacts a portion of the other side having a second width which is at least slightly less than the (predetermined) width of the running web. In other words, certain parts of successive increments of the underside of the running web are not biased against the film supplying device.

A presently preferred film supplying device includes a rotary applicator having a peripheral surface which carries a continuous film of flowable material toward the one side of the running web at the coating station. Such apparatus further comprises means for providing the peripheral surface of the rotary applicator with a film of flowable material; the material providing means can comprise a tank or another suitable source of flowable material, and a rotary transfer member (such as a roller) dipping into the source and contacting the peripheral surface of the rotary applicator.

A surface of the biasing means can be configurated, dimensioned and positioned in such a way that it includes a first portion in contact with the other side of the running web and at least one second portion spaced apart from the other side of the web. To this end, the surface of the biasing means can be provided with at least one recess (such as a circumferentially complete peripheral groove of a rotary roller-shaped biasing member), and the at least one second portion of the surface is then located in the at least one recess. The first and second portions of the surface of the biasing means can be configurated and dimensioned to establish a preselected pattern which determines the distribution of flowable material that is being supplied to the one side of the running web at the coating station.

The biasing means can be arranged to apply to the other side of the running web a pressure which is less than one bar, particularly approximately 0.5 bar.

In accordance with one presently preferred embodiment of the invention, the biasing means comprises at least one roller rotatable about an axis which is at least substantially normal to the predetermined direction (i.e., which extends transversely of the running web). The peripheral surface of the at least one roller of the biasing means is arranged to roll along the other side of the running web and can be provided with at least one substantially circumferentially extending recess (such as the aforementioned peripheral groove). At least that portion of the at least one roller which is adjacent its peripheral surface can consist of an elastomeric material, such as an elastomeric plastic material.

Alternatively, the biasing means can be configurated and mounted in such a way that its web-contacting surface is at least substantially stationary, i.e., that the other side of the running web is in sliding contact with the adjacent surface of the biasing means. At least that portion of the stationary bising means which defines the web-contacting surface can be made of or can contain a resilient material; for example, such portion of the stationary biasing means can be made of resilient metallic sheet material or of an elastomeric plastic material. The apparatus can further comprise a mobile support for the rotatable or non-rotatable biasing means; and the biasing means is preferably mounted on the support in such a way that it can ride on the advancing web at the coating station.

The novel features which are considered as characteristic of the invention are set forth in particular in the appended claims. The improved film applying apparatus itself, however, both as to its construction and the mode of assembling and operating the same, together with numerous additional important and advantageous features and attributes thereof, will be best understood upon perusal of the following detailed description of certain presently preferred specific embodiments with reference to the accompanying drawings.

BRIEF DESCRIPTION OF THE DRAWINGS

FIG. 1 is a schematic partly elevational and partly vertical sectional view of an apparatus which embodies one form of the invention and employs biasing means in the form of a horizontal roller riding on the upper side of the running web at the coating station;

FIG. 2 is an enlarged fragmentary plan view of the apparatus, substantially as seen in the direction of arrow II in FIG. 1.

DESCRIPTION OF PREFERRED EMBODIMENTS

Figure 3:
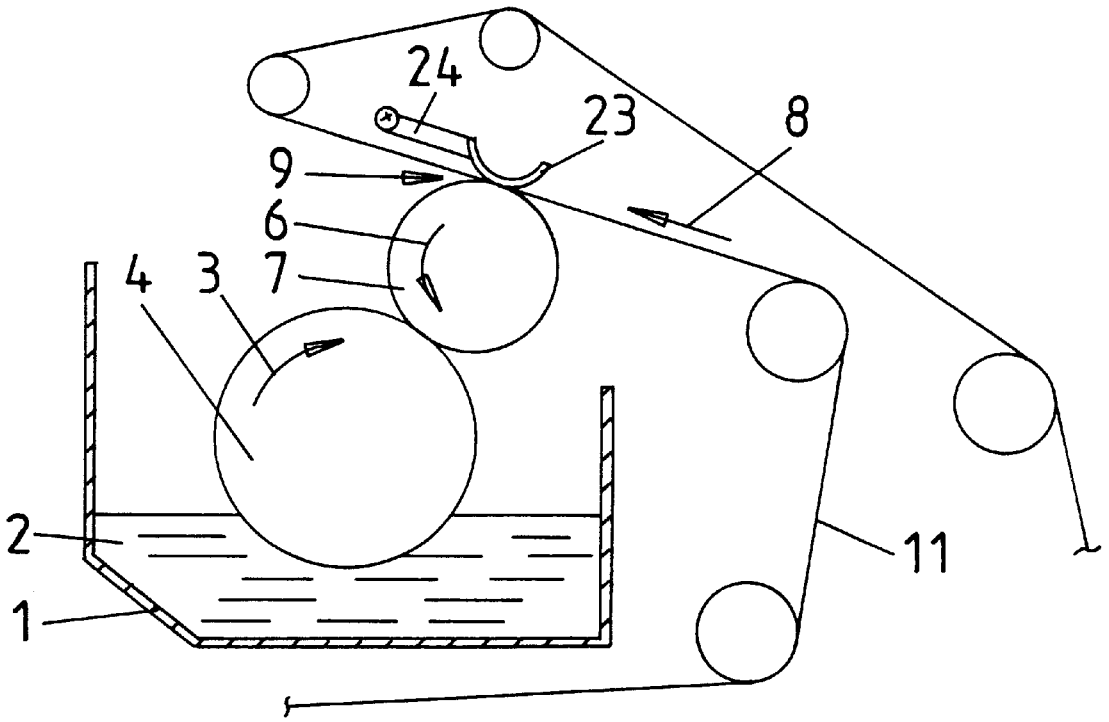
FIG. 3 is a schematic partly elevational and partly vertical sectional view of a modified apparatus which utilizes a non-rotatable biasing means.

The apparatus which is shown in FIGS. 1 and 2 comprises a vessel 1 which constitutes a source of flowable material 2, e.g., an adhesive substance which is to form a layer or film at the underside of a running web or strip 11 of cigarette paper, artificial cork or another flexible sheet material for use in a filter tipping machine. A machine of such character is shown in FIG. 1 of U.S. Pat. No. 4,249,547 to Hinzmann. The leader of the properly coated web 11 is severed at regular intervals (as at 21 in FIG. 1 of the patent to Hinzmann) to yield a series of discrete uniting bands ready to be convoluted about the filter mouthpieces and the adjacent end portions of plain cigarettes, cigars or cigarillos to form therewith filter cigarettes, cigars or cigarillos of unit length of multiple unit length.

The apparatus of FIGS. 1 and 2 further comprises a rotary film supplying device 7 which is a horizontal roller driven to rotate counterclockwise (arrow 6) about a horizontal axis extending transversely of the path of movement of the web 11 through a coating station 9. A portion of the cylindrical peripheral surface of a rotary roller-shaped transfer member 4 dips into the supply 2 of flowable material 2 in the vessel 1 and transfers a film of such material (see the arrow 3) to the cylindrical peripheral surface of the roller 7.

The web 11 is advanced in the direction which is indicated by the arrow 8 and is trained over several pulleys 12 which cause it to advance along a predetermined path extending through the coating station 9.

In accordance with a feature of the invention, the apparatus further comprises a biasing device 13 which is a horizontal roller mounted in such a way that it rides upon the running web 11 at the coating station 9, i.e., the peripheral surface of the roller 13 contacts the upper side of the web 11 along a horizontal line or strip which is shorter than the width of the web. This can be readily seen in FIG. 2 which shows that the axial length of the film supplying roller 7 exceeds but the axial length of the biasing roller 13 is less than the width of the web 11.

The fluid supplying roller 7 has a shaft 14 which is mounted in a stationary housing or frame 16 of the filter tipping machine. The peripheral surface of the roller 7 can apply a uniform or non-uniform film of flowable material to the entire underside of the running web 11, depending on the configuration of the peripheral surface of the roller 7. The shaft 19 of the biasing roller 13 is mounted at one end of a lever 17 which is pivotable relative to the frame 16 about a horizontal axis 18 so that the lever 17 enables the peripheral surface of the roller 13 to ride on the upper side of the running web 11. The dimensions and the combined weight of the parts 17, 19, 13 are preferably selected in such a way that the peripheral surface of the biasing roller applies to the web 11 a pressure which is less, and even much less, than one bar (e.g., approximately 0.5 bar). The biasing roller 13 rotates (clockwise, as viewed in FIG. 1) as a result of frictional engagement with the upper side of the running web 11.

The axial ends of the biasing roller 13 are located inwardly of the respective marginal zones of the web 11. This ensures that the roller 13 is unlikely, or much less likely, to squeeze some of the flowable material forming the film at the underside of the web 11 laterally and beyond the neighboring marginal zones. The laterally squeezed out flowable material could encrustate on and thus contaminate the pulleys 12 and/or other parts which guide the web toward the severing station.

On the other hand, the peripheral surface of the biasing roller 13 ensures a highly satisfactory distribution of flowable material along those portions of the underside of the web 11 which should be properly coated with such material.

The illustrated web 11 is assumed to consist of tipping paper, and such web is normally provided with perforations to permit the inflow of atmospheric air into the column of tobacco smoke flowing from the lighted end of a filter cigarette, cigar or cigarillo toward and through the filter mouthpiece. FIG. 2 shows that the web 11 has two longitudinally extending rows 21 of perforations, and such rows register with two circumferentially complete recesses in the form of grooves 22 machined into or otherwise formed in the peripheral surface of the biasing roller 13. The surface portions at the bottoms of the grooves 22 do not contact the upper side of the web 11 at the coating station 9 so that the perforations 21 are not likely or less likely to be clogged with flowable material, i.e., the permeability of the wrappers of finished filter cigarettes or other filter tipped smokers' products is more predictable than in the absence of the grooves 22.

An apparatus which can provide a running web of tipping paper with rows of longitudinally extending perforations is disclosed, for example, in commonly owned U.S. Pat. No. 4,469,111 granted Sep. 4, 1984 to Peter Pinck et al. for "APPARATUS FOR PERFORATING WEBS OF WRAPPING MATERIAL FOR TOBACCO OR THE LIKE".

The provision of means for reducing the likelihood of clogging the perforations in a web of filter tipping paper is disclosed in the aforementioned U.S. Pat. No. 4,249,547 to Hinzmann.

At least that portion of the biasing roller 13 which is adjacent its peripheral surface is or can be made of a suitable elastomeric material, e.g., rubber or silicone.

In order to afford rapid and convenient access to the biasing roller 13, the latter is (or can be) affixed to the lever 17 (or the lever 17 can be affixed to the frame 16) by a quick-release connection of any known design (e.g., a bayonet mount or the like). This ensures that a damaged or contaminated biasing roller can be rapidly replaced with a fresh roller.

FIG. 3 shows an apparatus which is identical with that of FIGS. 1 and 2, except that it employs a non-rotatable biasing device 23 mounted at the free end of a pivotable lever 24 so that it can ride on the upper sides of successive increments of the running web 13 which is caused to advance through the coating station 9. The biasing device 23 of FIG. 3 resembles a trough having a length less than the width of the web 11 and extending transversely of the direction which is indicated by the arrow 8. The biasing device 23 can be made of resilient sheet metal or other suitable resilient or elastic material (such as an elastomeric plastic substance). The underside of the device 23 can be provided with grooves (not visible in FIG. 3) which constitute functional equivalents of the recesses 22 in the peripheral surface of the rotary roller-shaped biasing device 13 of FIGS. 1 and 2. In other words, the web-contacting surface of each of the biasing devices 13, 23 can include portions which do contact and portions which cannot or should not contact the upper side of the web 11 at the coating station.

An important advantage of the improved apparatus is that it ensures a more predictable application of adhesive or other flowable material to one side of the running web 11. The application can but need not be uniform, depending on the desired ultimate distribution of flowable material at the coated side of the web. As already mentioned hereinbefore, a very important consideration in connection with the ultimate distribution of flowable material is to ensure that such material will not be squeezed laterally beyond the marginal portions of the web because this could result in rapid contamination of pulleys 12 and/or other parts which support, guide and advance the web and in time-consuming replacement and cleaning of such parts.

Another important reason to prevent glue from being squeezed laterally beyond the marginal portions of a web of tipping paper is that the adhesive which would be squeezed laterally beyond such marginal portions would set on and adversely affect the appearance of the tubular wrappers of filter cigarettes, cigars, cigarillos or other filter tipped rod-shaped smokers' products.

The recesses 22 of the rotary biasing device 13 and their equivalents (if any) in the non-rotatable biasing device 23 exhibit the important advantage that one can prevent undesirable clogging of any perforations in the rows 21, or that such clogging (and the attendant fluctuations of permeability of the wrappers of finished smokers' products) can be maintained within a readily acceptable range.

Proper (and particularly predictable) distribution of adhesive material at one side of a web of tipping paper is highly desirable and advantageous on the additional ground that this renders more predictable the operation of the wrapping mechanism (see the parts 23, 24 in FIG. 1 of the U.S. Pat. No. 4,249,547 to Hinzmann) which is designed to convolute properly coated and configurated uniting bands (severed portions of the web) around the filter mouthpieces and the adjacent end portions of plain cigarettes or the like. Predictable wrapping (especially the application of a satisfactory force) is desirable because it contributes to the quality and appearance of filter tipped smokers's products. This, combined with the absence of patches of hardened adhesive at the outer sides of the wrappers, contributes to the sales appeal of the ultimate products.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of pasters and the like and, therefore, such adaptations should and are intended to be comprehended within the meaning and range of equivalence of the appended claims.

What is claimed is:

1. Apparatus for applying a film of flowable material to one side of an elongated flexible web having a predetermined width and advancing lengthwise in a predetermined direction along a predetermined path through a coating station, comprising a film supplying device located at said station at the one side of the advancing web to provide the one side with the film of flowable material; and means for biasing said one side of the advancing web against said film supplying device at said station, said biasing means being adjacent another side of the web opposite said one side and only contacting a portion of said other side across a second width at least slightly less than said predetermined width.

2. The apparatus of claim 1, wherein the web contains paper.

3. The apparatus of claim 1, wherein the flowable material is an adhesive substance.

4. The apparatus of claim 1, wherein said film supplying device includes a rotary applicator having a peripheral film-carrying surface, and further comprising means for providing the peripheral surface with a film of flowable material.

5. The apparatus of claim 4, wherein said means for providing comprises a source of flowable material and a rotary transfer member dipping into said source and contacting the peripheral surface of said rotary applicator.

6. The apparatus of claim 1, wherein said biasing means has a surface including at least one first portion in contact with the other side of the advancing web, and at least one second portion spaced apart from said other side.

7. The apparatus of claim 6, wherein said surface of said biasing means has at least one recess and said at least one second portion of the surface of said biasing means is located in said recess.

8. The apparatus of claim 6, wherein said portions of said surface of said biasing means establish a predetermined pattern which determines the distribution of flowable material that is supplied to the one side of the advancing web at said station.

9. The apparatus of claim 1, wherein said biasing means is arranged to apply to the other side of the advancing web a pressure which is less than one bar.

10. The apparatus of claim 9, wherein said pressure is approximately 0.5 bar.

11. The apparatus of claim 1, wherein said biasing means comprises at least one roller.

12. The apparatus of claim 11, wherein said at least one roller is rotatable about an axis which is at least substantially normal to said predetermined direction, said at least one roller having a peripheral surface arranged to roll along said other side of the advancing web and having at least one substantially circumferentially extending recess.

13. The apparatus of claim 11, wherein said at least one roller has a peripheral web-contacting surface, at least that portion of said roller which is adjacent said peripheral surface consisting of an elastomeric material.

14. The apparatus of claim 13, wherein said elastomeric material is a plastic material.

15. The apparatus of claim 1, wherein said biasing means has a web-contacting surface and said other side of the advancing web is in sliding contact with said surface of said biasing means.

16. The apparatus of claim 15, wherein said biasing means includes a portion which is provided with said web-contacting surface and contains a resilient material.

17. The apparatus of claim 16, wherein said portion of said biasing means consists of a metallic sheet material.

18. The apparatus of claim 16, wherein said portion of said biasing means contains an elastomeric plastic material.

19. The apparatus of claim 1, further comprising a mobile support for said biasing means, said biasing means being arranged to ride on the advancing web at said station.

* * * * *